US008061635B2

(12) United States Patent
Kim et al.

(10) Patent No.: US 8,061,635 B2
(45) Date of Patent: Nov. 22, 2011

(54) AUTOMATIC PAPER SUPPLY APPARATUS FOR PAPER SHREDDER

(75) Inventors: Hak Hyun Kim, Pohang-si (KR); Woon Gi Kim, Incheon (KR)

(73) Assignee: Royal Sovereign Qingdao Inc. (CN)

( * ) Notice: Subject to any disclaimer, the term of this patent is extended or adjusted under 35 U.S.C. 154(b) by 74 days.

(21) Appl. No.: 12/677,203

(22) PCT Filed: Sep. 17, 2007

(86) PCT No.: PCT/KR2007/004467

§ 371 (c)(1), (2), (4) Date: Mar. 12, 2010

(87) PCT Pub. No.: WO2009/035178

PCT Pub. Date: Mar. 19, 2009

(65) Prior Publication Data

US 2010/0320675 A1 Dec. 23, 2010

(30) Foreign Application Priority Data

Sep. 10, 2007 (KR) ..... 10-2007-0091638

(51) Int. Cl.
*B02C 18/22* (2006.01)

(52) U.S. Cl. ..... 241/36; 241/37.5; 241/225; 241/236; 271/109; 271/162; 271/265.01

(58) Field of Classification Search ..... 241/36, 241/37.5, 100, 236, 224, 225; 271/109, 162, 271/265.01

See application file for complete search history.

(56) References Cited

U.S. PATENT DOCUMENTS

| | | | | |
|---|---|---|---|---|
| 6,199,855 | B1 | 3/2001 | Choeng et al. | |
| 6,651,971 | B2 | 11/2003 | Tsuei | |
| 2010/0044484 | A1 * | 2/2010 | Chen | 241/101.5 |

FOREIGN PATENT DOCUMENTS

| | | |
|---|---|---|
| JP | 2003-285945 | 10/2003 |
| JP | 2003-285946 | 10/2003 |
| KR | 1998-056764 | 10/1998 |

OTHER PUBLICATIONS

International Search Report—PCT/KR2007/004467 dated Jun. 10, 2008.

* cited by examiner

*Primary Examiner* — Mark Rosenbaum
(74) *Attorney, Agent, or Firm* — Cantor Colburn LLP

(57) ABSTRACT

Disclosed is an automatic paper supply apparatus for a paper shredder which can shred stapled paper sheets regardless of the volume or thickness of the paper sheets to be shredded. The present invention can shred stapled paper sheets without need to previously remove the staples thereof, increases the user's safety, and prevents damage to the apparatus.

18 Claims, 13 Drawing Sheets

[Fig. 1]
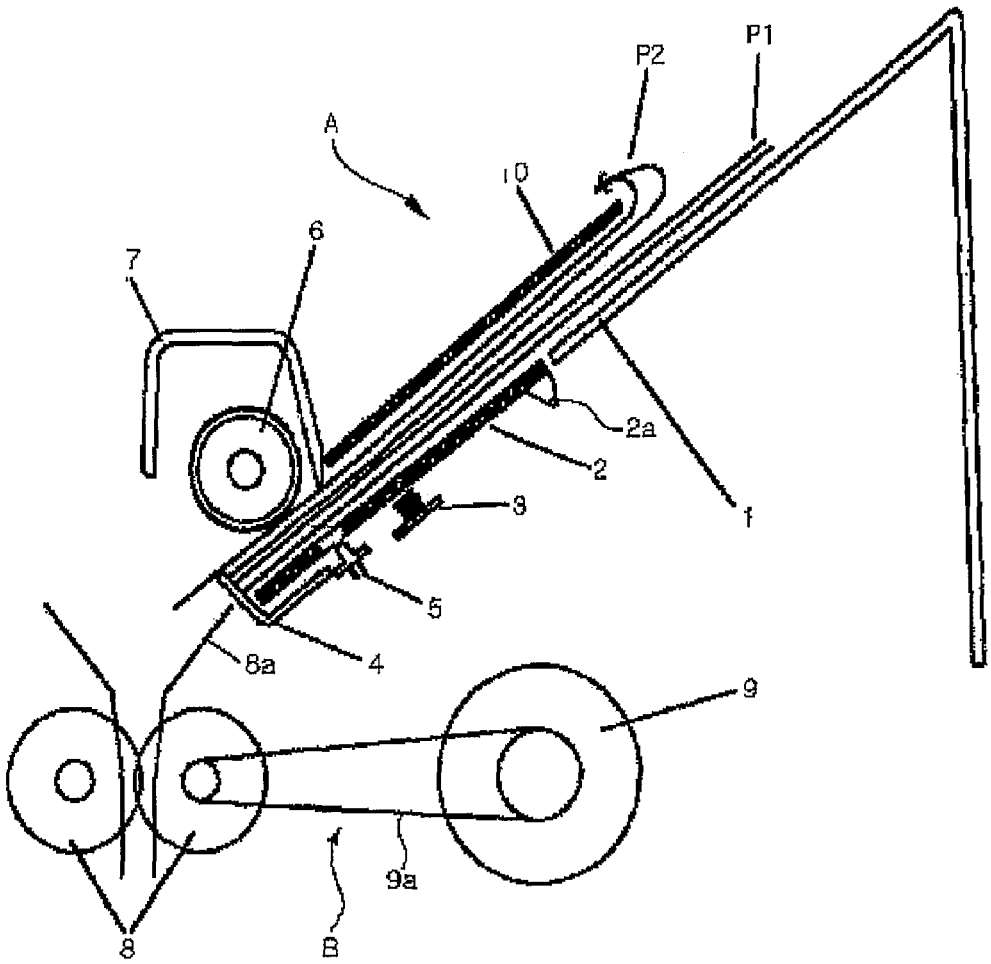

[Fig. 2]
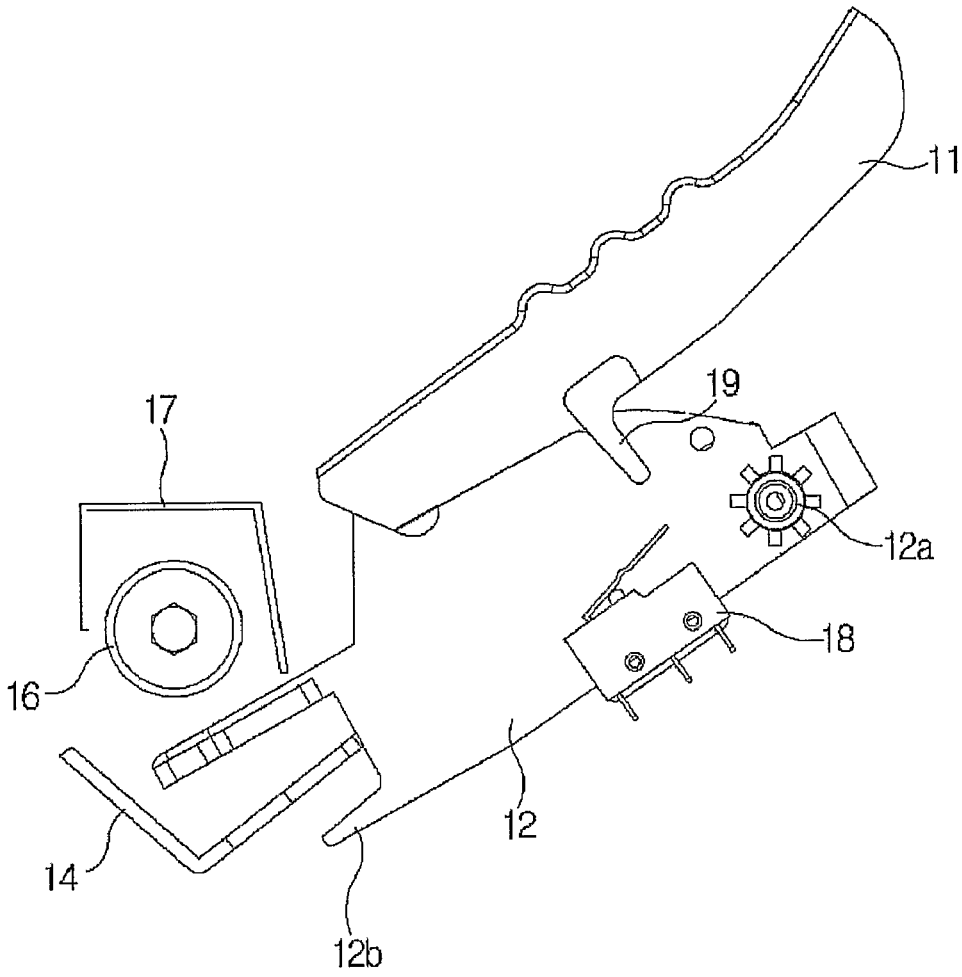

[Fig. 3]
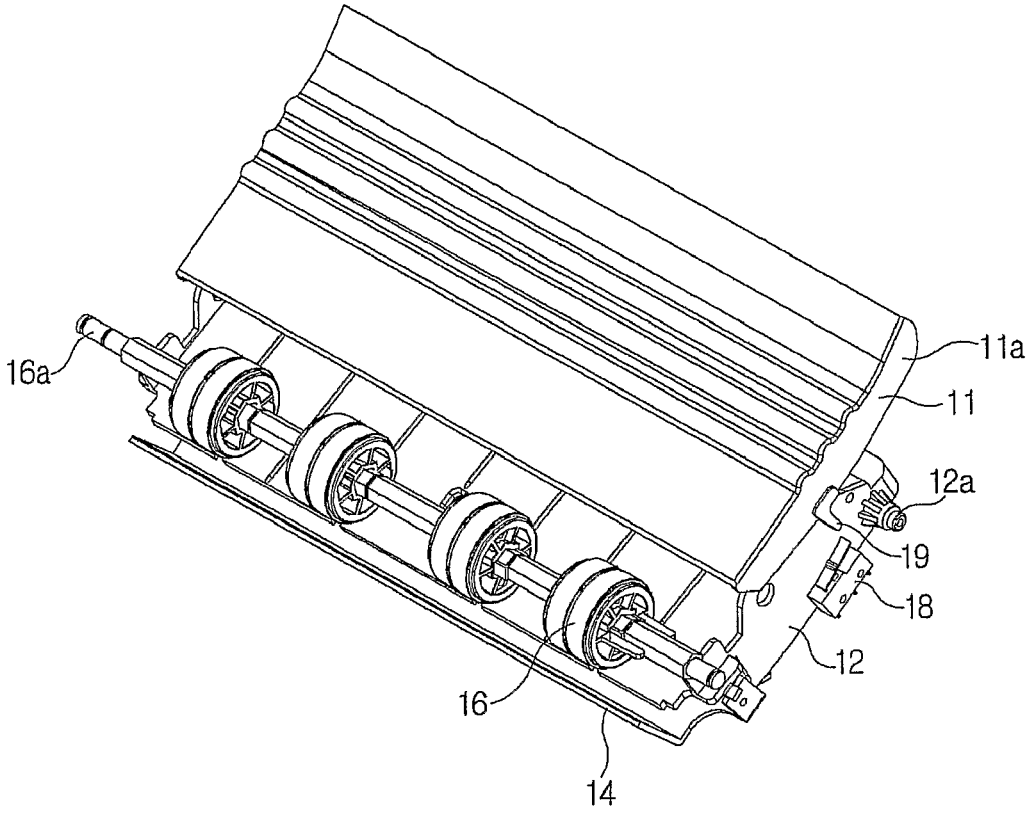

[Fig. 4]
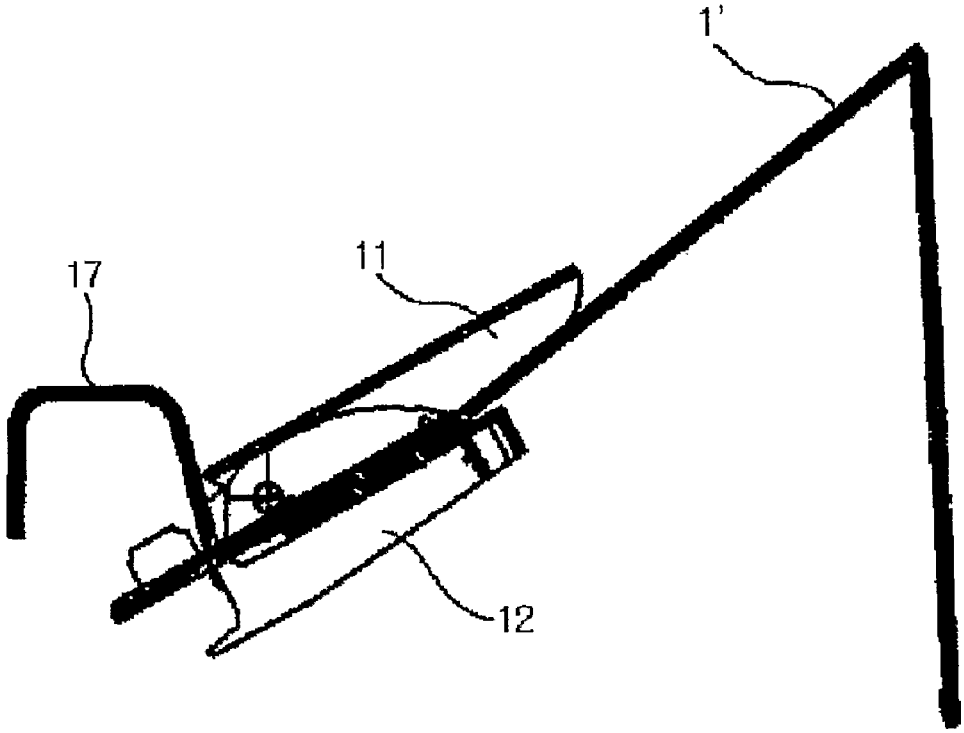

[Fig. 5]
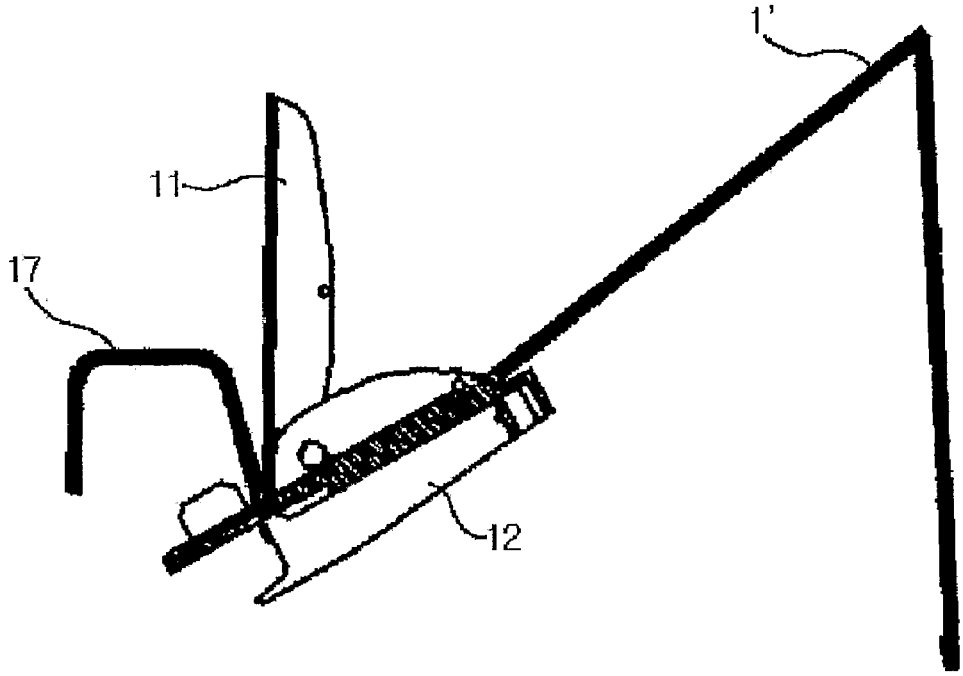

[Fig. 6]
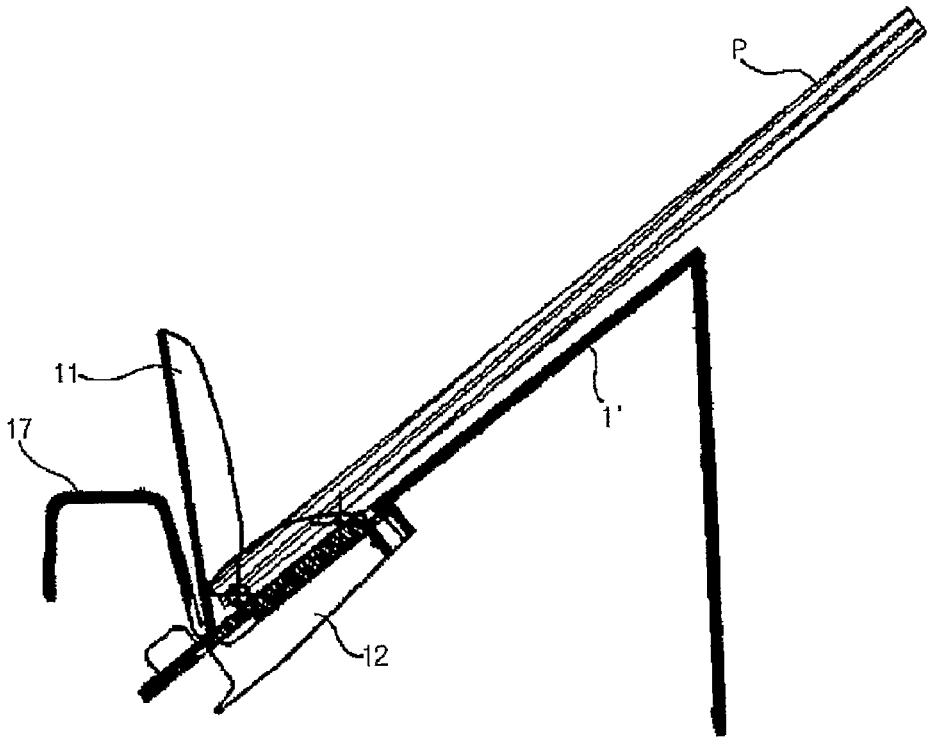

[Fig. 7]
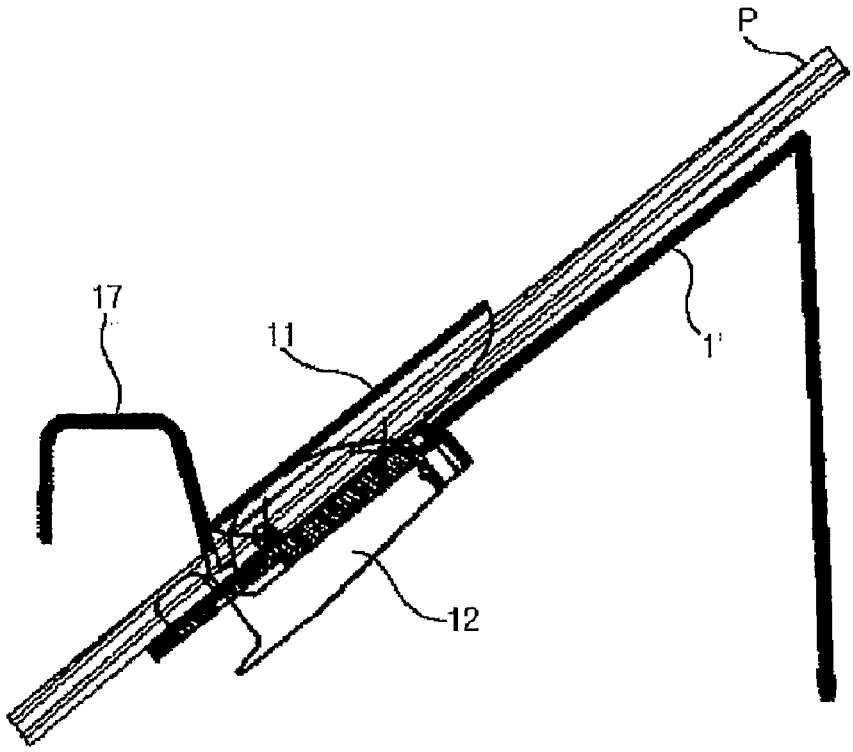

[Fig. 8]
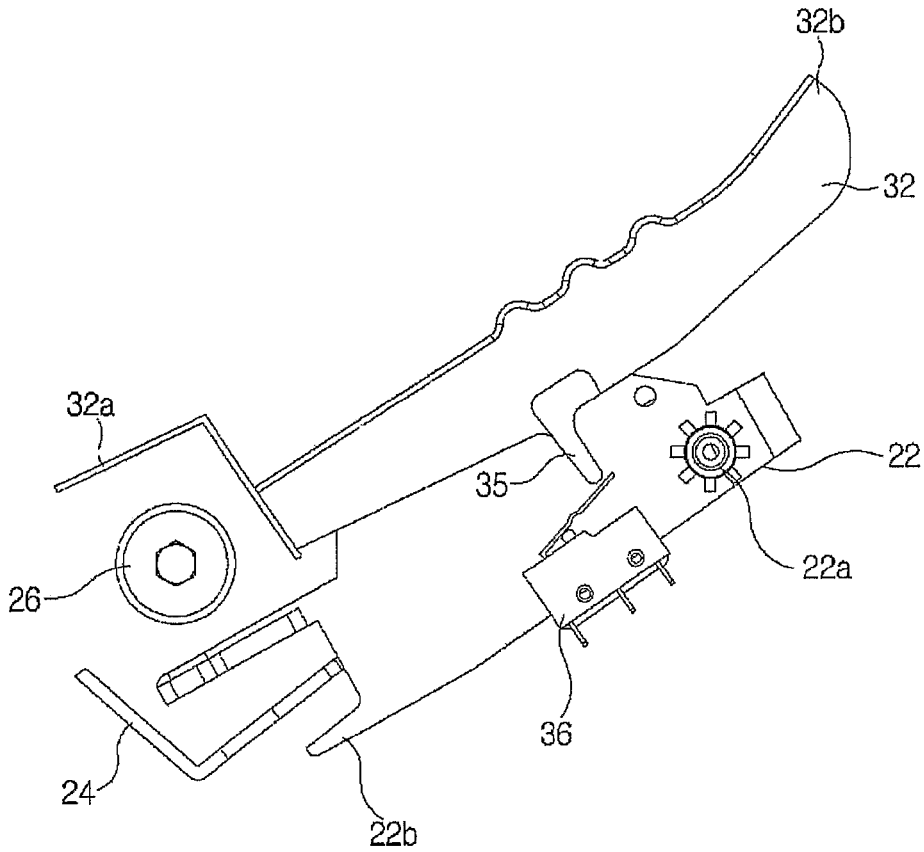

[Fig. 9]
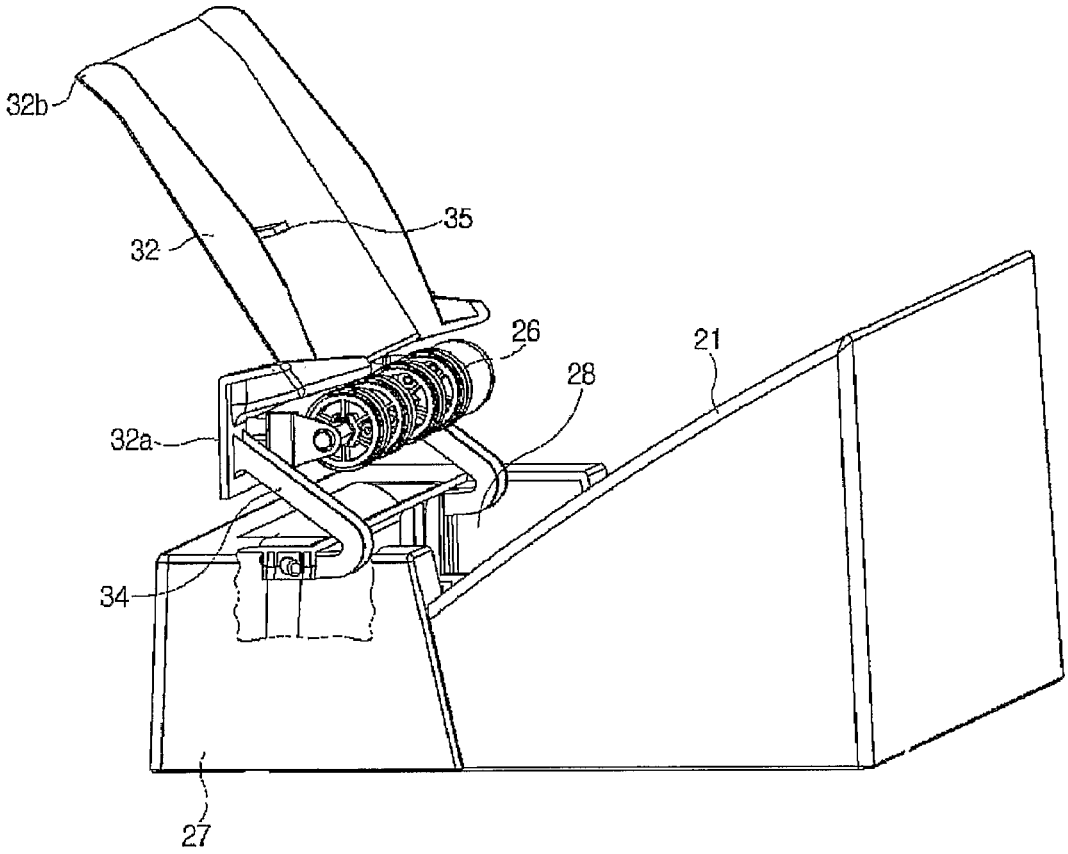

[Fig. 10]
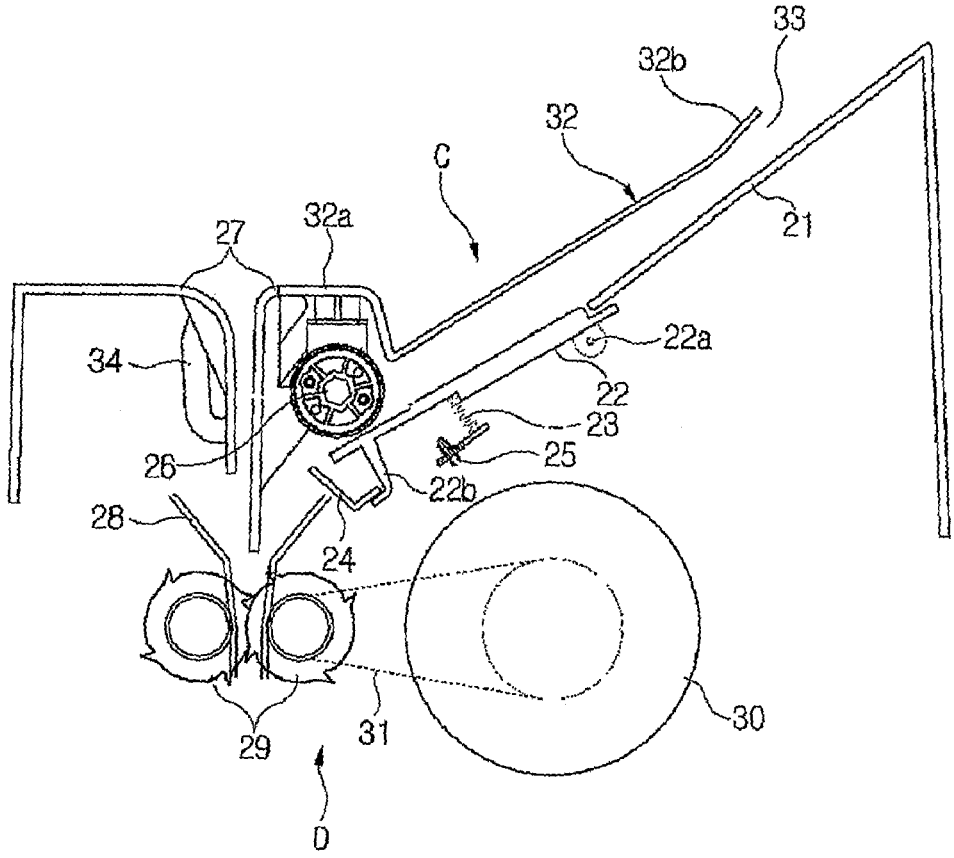

[Fig. 11]
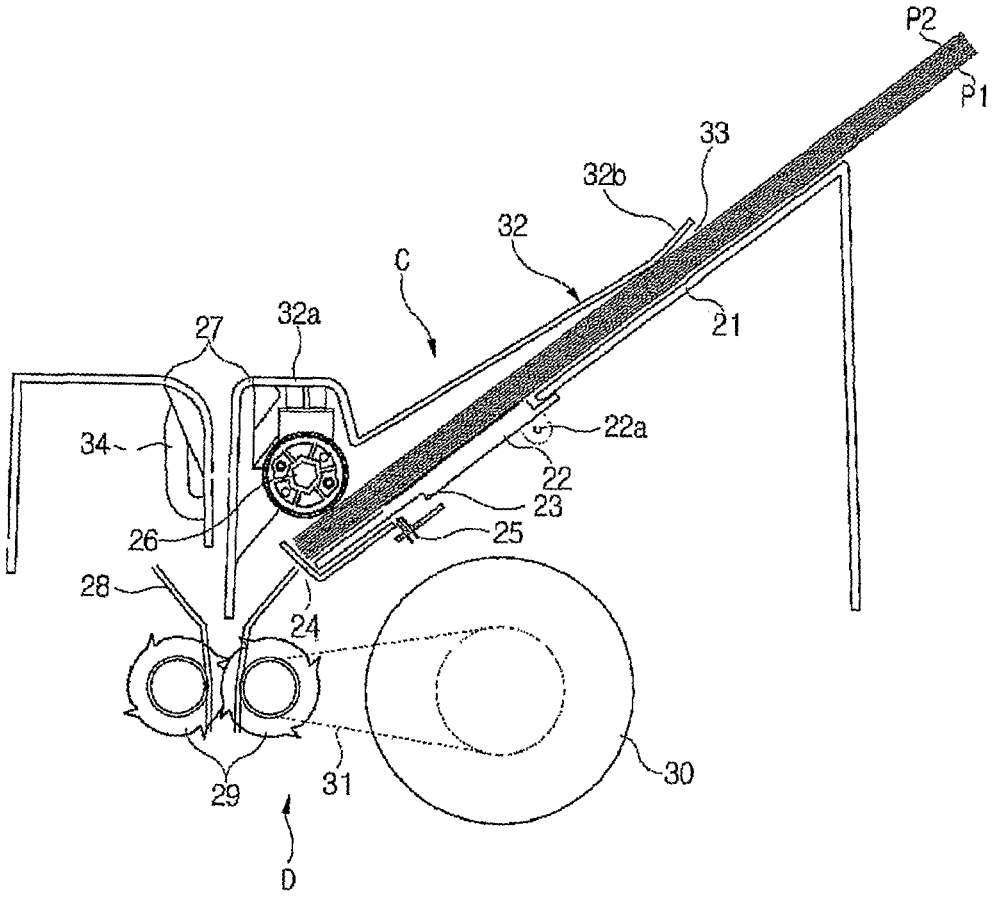

[Fig. 12]
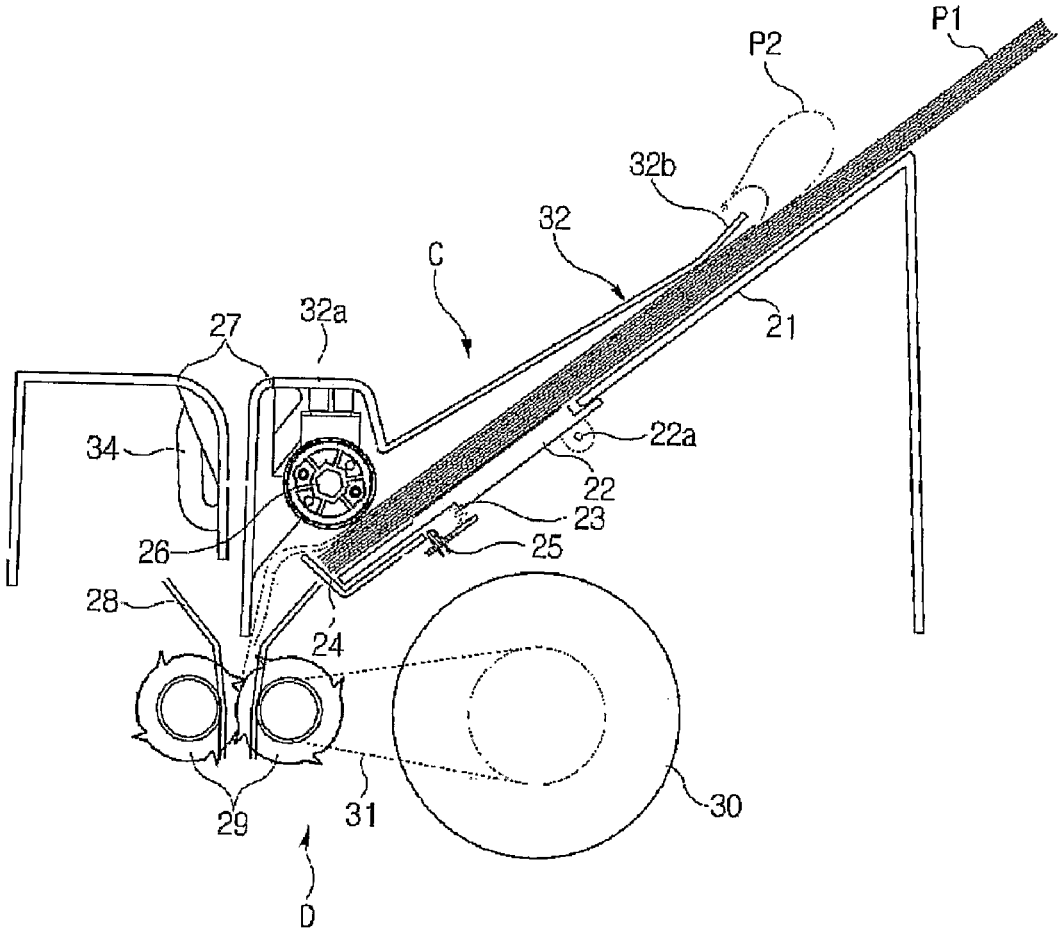

[Fig. 13]
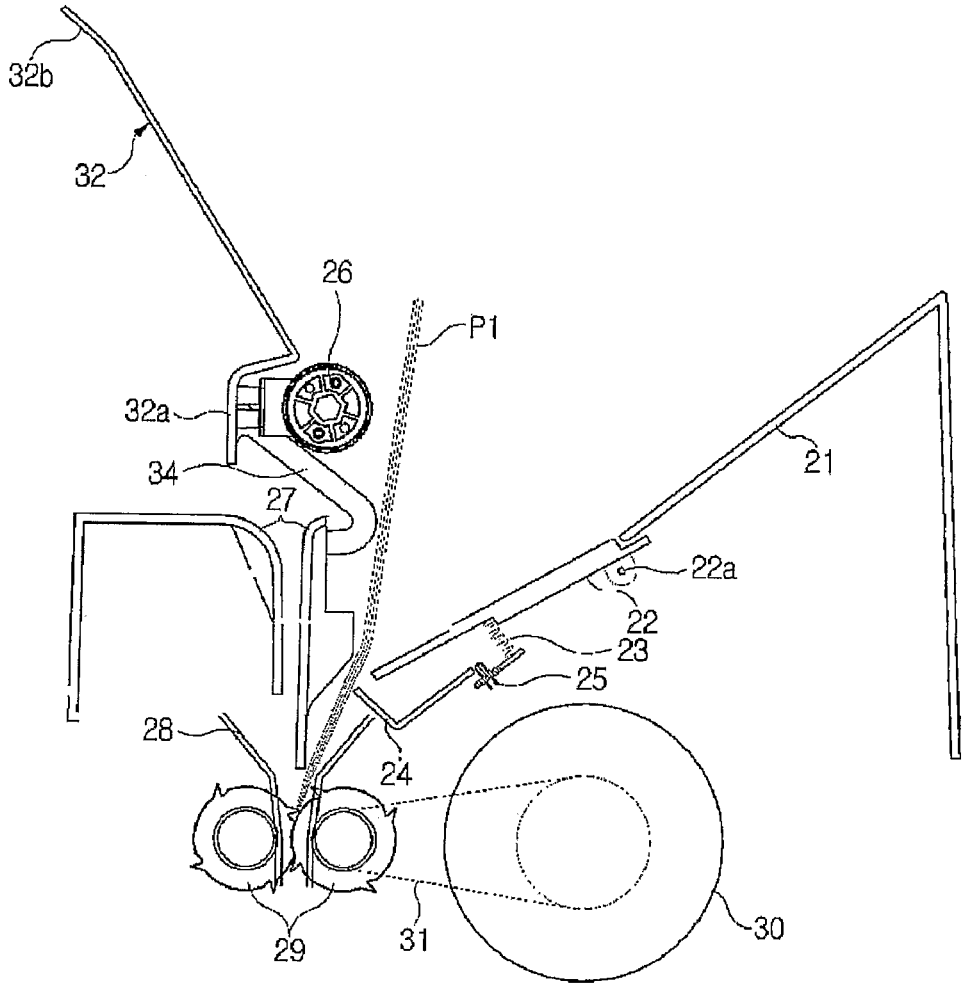

AUTOMATIC PAPER SUPPLY APPARATUS FOR PAPER SHREDDER

TECHNICAL FIELD

The present invention relates to a paper shredder, and more particularly to an automatic paper supply apparatus of a paper shredder which can automatically shred stapled paper sheets regardless of the volume or thickness of the stapled paper sheets to be shredded.

BACKGROUND ART

As generally known in the art, a paper shredder is an office appliance which rapidly and safely shreds secret paper sheets so as to dispose of it. A paper shredder has recently had a structure having an automatic paper supply function as well as a manual paper supply function as a basic function.

An automatic paper supply function refers to automatically supply a proper quantity of paper sheets. Although a large number of paper sheets is put at once on a paper supply part of an automatic paper supply apparatus, the paper sheets are divided into the proper number of sheets of paper as many as the paper shredder can shred at one time, and then are automatically input into the interior of the automatic paper supply apparatus several times.

Such an automatic paper supply function makes it possible to successively shred a large number of paper sheets by loading of paper sheets with no need to the user to input a sheaf of paper to be shredded into the paper supply part in each time, thereby increasing efficiency in work and convenience in use.

However, in a case of stapled paper sheets, the conventional paper shredder having an automatic paper supply function has to shred paper sheets only when its staple is removed. If the stapled paper sheets are shredded in a stapled state, particularly if the thickness of the stapled paper sheets exceeds the thickness of the number of paper sheets which the paper shredder can shred at one time, the shredding working through the paper shredder can not be progressed any more.

Furthermore, in the conventional paper shredder having an automatic paper supply function, a metallic pin or a sharped protuberance for controlling the quantity of paper automatically supplied is added to a feed roller thereof so as to allow several pieces of paper to be simultaneously supplied, thereby increasing performance in supplying paper. However, in this case, if the user's hand is scratched by the metallic pin or the sharped protuberance, a serious accident can be easily caused.

DISCLOSURE OF INVENTION

Technical Problem

The present invention has been made to solve the above-mentioned problems occurring in the prior art, and the present invention provides an automatic paper supply apparatus for a paper shredder which simultaneously performs the operation of removing the staple of paper sheets to be shredded and the operation of shredding the paper sheets, if there are stapled paper sheets, without a process for previously removing the staple thereof before inputting the paper sheets into the automatic paper supply apparatus, and without need to stop the operation of the automatic paper supply apparatus so as to remove the staple thereof.

Also, the present invention provides an automatic paper supply apparatus for a paper shredder having a structure which can prevent the user's hands or items from being input into the paper shredder and control the operation thereof, so that safety increases and damage to the paper supply apparatus can be prevented.

Technical Solution

In accordance with an aspect of the present invention, there is provided an automatic paper supply apparatus for a paper shredder, which includes a paper supply part for supplying paper sheets to be shredded; a shredding part for shredding paper sheets supplied by the paper supply part in pieces; a paper loading stand for loading paper sheets to be shredded, the paper sheets being loaded while facing the shredding part; a supporting jaw installed at a front end of the paper loading stand so as to keep and support the paper sheets to be shredded; a lifting board included in the paper loading stand in such a manner that the lifting board can be rotated toward an upper direction; a feed sensor which is positioned at a lower part of the lifting board so as to sense if paper sheets to be shredded are supplied; a feed roller positioned at an upper part of the lifting board, the feed roller being driven when the feed sensor senses paper sheets, and so as to carry the paper sheets to be shredded to the shredding part; a pressing spring which elastically supports the lifting board and allows the paper sheets to be shredded, which has been put on the paper loading stand, to face the feed roller of an upper part of the paper shredder; and a catching board which is positioned above an upper part of the paper loading stand while being spaced from the paper loading stand, and allows a sheet of paper at an upper layer of stapled paper sheets to be released from the stapled part of the paper sheets.

It is preferable that the feed sensor may be a contact-type sensor or an optical sensor, the shredding part includes a plurality of rotational cutters shredding paper sheets supplied by the feed roller and a driving motor connected with the rotational cutter by means of a predetermined connection means so as to transfer rotation power to the rotational cutters, the driving motor is connected with the feed roller by means of a predetermined connection means, and power transference by means of the connection means is performed by a belt, a chain, or a gear driving manner.

The catching board is hinge-coupled at both ends of the lifting board in such a manner that the catching board can be rotated in upward and downward and, so that when a rear portion of the catching board is lifted, a front end of the catching board is rotated about a shaft and makes contact with an upper surface of a bottom of the lifting board at the front side of the catching board so as to block an inputting path of paper sheets.

The automatic paper supply apparatus includes a predetermined control means sensing if the catching board is lifted up or pulled down so as to control driving of the driving motor, wherein the control means may preferably be a micro switch or a sensor.

The control means is installed at one side of the paper loading stand or the lifting board, and the present invention further includes an operation protuberance, as a means for operating the control means, installed at one end of the lifting board, which corresponds to a position of the control means. It is preferable that in a state where the catching board has been pulled down, the control means is pushed by the operation protuberance so as to make contact with the operation protuberance so as to maintain a "ON" state of the control means, in a state where the catching board has been lifted up, the operation protuberance is spaced and separated from the control means so as to maintain a "OFF" state, the driving motor can be driven in the "ON" state, and the driving motor can not be driven in the "OFF" state.

In the automatic paper supply apparatus for a paper shredder, the catching board is integrally connected with a roller cover covering an upper part of the feed roller.

Advantageous Effects

Accordingly, the present invention can shred stapled paper sheets in a state where the staple thereof has not been previously removed, and additionally secure safety in use and prevent damage to the paper shredder from the operation thereof.

BRIEF DESCRIPTION OF THE DRAWINGS

FIG. 1 is a schematic view illustrating the first embodiment of an automatic paper supply apparatus according to the present invention;

FIG. 2 is a schematic view illustrating the second embodiment of an automatic paper supply apparatus according to the present invention;

FIG. 3 is a perspective view illustrating the state of an automatic paper supply apparatus according to the second embodiment of the present invention while being assembled;

FIGS. 4 to 7 are schematic views sequentially illustrating the state of the automatic paper supply apparatus of FIG. 2 while being used;

FIG. 8 is a schematic view illustrating the third embodiment of an automatic paper supply apparatus according to the present invention;

FIG. 9 is a perspective view illustrating the assembled state of an automatic paper supply apparatus according to the third embodiment of the present invention while being assembled; and FIGS. 10 to 13 are schematic views sequentially illustrating the state of an automatic paper supply apparatus of FIG. 8 while being used.

MODE FOR THE INVENTION

Hereinafter, preferred embodiments of an automatic paper supply apparatus for a paper shredder according to the present invention will be described with reference to the following drawings.

Embodiment 1

FIG. 1 is a schematic view illustrating a structure of a paper shredder including an automatic paper supply apparatus according to the first embodiment of the present invention, and the state of the paper shredder which is operated by the automatic paper supply apparatus. The paper shredder includes an automatic paper supply part A (hereinafter, referred to as "an automatic paper supply apparatus"), which supplies or inputs paper sheets to be shredded to the paper shredder, and a shredding part (B), which shreds the paper sheets supplied through the automatic paper supply part A so as to dispose of them. The automatic paper supply apparatus A is positioned at the upper part of the shredding part B, and is included in the interior of the paper shredder, particularly in a paper loading stand 1, which is slanted toward the shredding part B. A supporting jaw 4 is included at the front end of the paper loading stand 1 slanted toward the shredding part B so as to support and maintain paper sheets P1 and paper sheets P2 to be put on the paper loading stand 1 so as to be shredded.

As an element constituted in the automatic paper supply apparatus, a lifting board 2, which can be rotated about one shaft 2*a* (a rotational shaft) toward an upper direction, is included in the paper loading stand 1. The lifting board 2 is elastically supported by a pressure spring 3, and performs a function for pushing the paper sheets P1 and the paper sheets P2, which have been put on the paper loading stand 1 to be shredded, toward a feed roller 6 of the upper part of the paper loading stand 1. Although not shown in the drawings, the pressure spring 3 can be connected with the upper part of the lifting board 2 so as to pull the lifting board toward the feed roller 6.

Also, a feed sensor 5, which senses if paper sheets to be shredded are supplied, is included at a side of the lifting board 2. When the paper sheets to be shredded is put on the lifting board 2 through the paper loading stand 1, the feed sensor 5 directly senses the descent of the lifting board 2 or the input of the paper sheets P1 and the paper sheets P2 to be shredded so as to drive the feed roller 6 according to the result of the sensing.

The feed sensor 5 may use a contact-type sensor for sensing contact with a sheet of paper so as to sense if the paper sheets P1 and the paper sheets P2 are input, and also may use an optical sensor for sensing if the paper sheets P1 and the paper sheets P2 to be shredded are supplied in a floodlight or a light shielding manner.

The feed roller 6 having an upper part thereof covered by a roller cover 7 is provided, and the roller cover 7 fixed in the body part (not shown) of the paper shredder is provided.

As an element constituted in the shredding part B, a plurality of rotational cutters 8 for shredding supplied paper sheets and a guide part 8*a* for guiding these paper sheets between the rotational cutters 8 are included at the lower part of the front side of the paper loading stand 1. The rotational cutters 8 can be rotated by the operation of a driving motor 9 connected with the rotational cutter 8 by a belt 9*a* (a connection belt). The driving motor 9 can be driven by the feed sensor 5 for sensing the descent of the lifting board 2 or the input of the paper sheets P1 and the paper sheets P2 to be shredded.

In the present invention, the power transference method using the connection belt 9*a* may be displaced with a method using a chain or a gear driving method, and through this displaced method, the power of the driving motor 9 can be transferred to the rotational cutters 8, similarly to the connection belt 9*a*.

Meanwhile, although not shown in the drawings, the driving motor 9 is also preferably connected with the feed roller 6 through a belt, a chain, or a gear, etc.

Also, when there are stapled paper sheets P2 among paper sheets to be shredded which are put on the paper loading stand 1, the paper shredder according to the present invention includes a catching board 10 for releasing the stapled state thereof. The catching board 10 is installed above the paper loading stand along the slanted surface thereof while being spaced a predetermined interval from the paper loading stand 1 so as to allow the paper sheets to be input into the paper loading stand 1, and an end of the catching bar 10 picks out a stapled part of stapled paper sheets P2 during a shredding process.

Hereinafter, a process of shredding paper sheets through a paper shredder including an automatic paper supply apparatus A having the above-described structure will be described.

When a sheaf of paper, particularly paper sheets P1 and the paper sheets P2, to be shredded is put on the paper loading stand 1, the feed sensor 5 senses the input of the paper sheets to be shredded and immediately drives the driving motor 9.

When the driving motor 9 is driven, the rotational cutters 8 and the feed roller 6 are driven so that the standby state of the paper shredder is prepared so as to shred.

The paper sheets P1 and the paper sheets P2 are supported by the supporting jaw 4 in a state of them being put on the paper loading stand 1. The pressure spring 3 presses the lifting board 2 toward an upper direction, and the lifting board 2 is pushed upward about a rotational shaft 2*a* of both sides thereof so as to allow the paper sheets to be shredded to be lifted up to the feed roller 6.

Among the paper sheets to be shredded which are pushed upward by the lifting board 2, a sheet of paper at the highest layer makes close contact with the feed roller 6. When the feed roller 6 is driven so that the sheet of paper at the highest layer passes the supporting jaw 4 and is discharged to the shredding part B, a sheet of paper, which has been at the next layer, becomes the sheet of paper at the highest layer by the elastic force of the pressure spring 3, so that the sheet of paper makes close contact with the feed roller 6 so as to be sequentially discharged. The paper sheets P1, which pass the supporting jaw 4 so as to be charged by the feed roller 6, are input between the rotational cutters 8 through the guide 8*a* so that a shredding operation is progressed.

According to the present invention, when there are stapled paper sheets P2 among paper sheets to be shredded, each sheet of paper can be released from the staple thereof so as to be shredded. In this case, the stapled paper sheets P2 are preferably put on the paper loading stand 1 in such a manner that the stapled part thereof is positioned toward a rear direction of the paper shredder.

When the stapled paper sheets P2 are input on the paper loading stand 1, the feed sensor 5 simultaneously senses the inputting of the paper sheets to be shredded so as to drive the driving motor 9, and the rotational cutters 8 and the feed roller 6 are simultaneously driven.

The feed roller 6 pushes a sheet of paper or several sheets of paper of the stapled paper sheets P2 toward a discharging direction. In this state, a front portion of a sheet of paper at an upper layer of the stapled paper sheets P2 is pulled so that resisting force against the pulling force is applied between the sheet of paper at the upper layer thereof and a sheet of paper at the lower layer thereof.

According to such an operation, the rear portion of the stapled paper sheets P2, particularly the stapled part thereof, is curved toward a front direction, i.e toward a discharging direction of the paper sheets.

At this time, the curved stapled part is caught by the catching board 10, and the feed roller 6 continuously pushes a sheet of paper as the upper layer of the paper sheets so as to input it into the rotational cutters 8. Therefore, the sheet of paper input into the rotational cutters 8 can be released from the staple thereof. Furthermore, according to the above-mentioned manner, the remaining paper sheets of the stapled paper sheets P2 are transferred and input into the rotational cutters 8 in a state where the stapled parts thereof are caught by the catching board 10, so that they are shredded by the rotational cutter 8 while a sheet of paper or several sheets of papers thereof is sequentially taken away from the paper sheets.

Embodiment 2

FIG. 2 is a schematic view illustrating the second embodiment of the automatic paper supply apparatus according to the present invention, FIG. 3 is a perspective view illustrating an assembled automatic paper supply apparatus according to the second embodiment of the present invention, and FIGS. 4 to 7 are schematic views sequentially illustrating the state of the automatic paper supply apparatus of FIG. 2 while being used.

According to the present invention, the automatic paper supply apparatus has a structure allowing a catching board 11 to be rotated as described in FIG. 1. The catching board 11 has such a rotational structure so as to protect the user's hand from the operation of the paper shredder and also simultaneously protect against damage to the paper shredder caused by input of outer stuffs. The catching board 11 of the automatic paper supply apparatus as shown in FIG. 2 is rotatably hinged-coupled with both ends of the lifting board 12 so as to allow the rear portion thereof can be lifted.

As shown in FIG. 2, when the rear portion of the catching board 11 is lifted, the catching board 11 has an operational structure where the front end of the catching board 11 makes contact with the upper surface of the bottom of the lifting board 12 at each front part of the feed roller 16 and the roller cover 17 while rotating about a rotational shaft (not shown).

In the automatic paper supply apparatus having such a structure of FIG. 2, when the rear portion of the catching board 11 is lifted so that the front end of the catching board 11 makes contact with the upper surface of the bottom of the lifting board 12, an inputting path of paper sheets toward the rotational cutters (not shown; refer to FIG. 1) is closed. Meanwhile, when the rear portion of the catching board 11 is pulled down so as to be positioned at the initial place, the inputting path of paper sheets is opened as shown in FIG. 1.

Also, the automatic paper supply apparatus of FIG. 2 includes a control means which senses if the catching board 11 is lifted up or pulled down and controls the driving of the driving motor (not shown; refer to FIG. 1). An electric or electron control apparatus, such as a micro switch or a sensor, etc., can be selected to be used as such a control means. In the present invention, a micro switch 18 as an example of such a control means being used will be described through FIGS. 2 and 3.

The micro switch 18 can be installed at the paper loading stand 1' (refer to FIG. 4) or at a position adjacent thereto, and an operation protuberance 19 as a means for controlling the micro switch 18 can be installed at a position corresponding to the position at which the micro switch 18 is installed. In the present invention, the micro switch 18 can be installed at one end of the lifting board 12 as shown in FIG. 2, and the operation protuberance 19 can be installed at one end of the catching board 11, which is a position corresponding to the micro switch 18.

The micro switch 18 is pushed by the operation protuberance 19 and makes contact with it in a state of the catching board 11 being pulled down so as to maintain the "ON" state thereof. Meanwhile, in a state of the catching board 11 being lifted up, the micro switch 18 is spaced and separated from the operation protuberance 19 so as to maintain the "OFF" state. The driving motor (not shown; refer to FIG. 1) can be driven in the ON" state of the micro switch 18. On the other hand, the driving motor can not be driven in the "OFF" state of the micro switch 18.

Although not shown in the drawings, when the driving motor is driven, the feed roller 16 and the rotational cutters (not shown: refer to FIG. 1) are driven as shown in FIG. 1, and when the driving motor is stopped, the feed roller 16 and the rotational cutters are also stopped.

The numeric reference '12*a*', which is not described in FIG. 2, refers to the rotational shaft, the numeric reference '12*b*' is a latching protuberance, and the numeric reference '14' refers to the supporting jaw. Also, the numeric reference '11*a*', which is not described in FIG. 3, refers to a catching tip, and the numeric reference '16*a*' refers to a roller shaft.

In FIG. 2, the latching protuberance 12*b* is used for preventing the lifting board 12 lifted by the pressure spring 3 (refer to FIG. 1) from making close contact with the feed roller 16. At least one side of the lifting board 12 has a protrusion-shape and is locked in the supporting jaw 14 while keeping a predetermined interval between the lifting board 12 and the feed roller 16. Of course, although not shown in FIG. 1, a latching protuberance can be provided in the structure in FIG. 1.

Hereinafter, the automatic paper supply apparatus according to the present invention, while being used and operated, will be described with reference to FIGS. 4 to 7.

FIG. 4 is a view illustrating the standby state of the automatic paper supply apparatus. The catching board 11 is pulled down so that the inputting path of paper she gets, which is toward the rotational cutters 8 (refer to FIG. 1), is opened.

Also, in the case of the standby state of FIG. 4, when the operation protuberance 19 turns on the micro switch 18 so as to apply power to the paper shredder, and then paper sheets to be shredded is input into the paper shredder, the driving motor 9 (refers to FIG. 1) is driven so that the feed roller 16 and the rotational cutters 8 are also driven.

FIG. 5 is a view illustrating the standby state of the automatic paper supply apparatus. The catching board 11 is lifted up so that the inputting path of paper sheets, toward the rotational cutter 8, is closed. In a state of the catching board being lifted, it is possible to remove alien substances from the interior of the catching board or the shredding chip.

Also, in the standby state of FIG. 5, although the operation protuberance turns on the micro switch so as to apply power to the paper shredder, the driving motor 9 is stopped so that the feed roller 16 and the rotational cutter 8 are also stopped.

FIG. 6 shows a case where paper sheets P to be shredded are input into the paper shredder. The inputting path of paper sheets, which is toward the rotational cutters 8 as a shredding part, is closed so that it is possible to prevent paper sheets from being supplied to the feed roller 16. In this state, as well as paper sheets to be shredded, the user's hands or outer items are also prevented from being inputting therein. FIG. 7 shows a case of the catching board 11 being pulled down from the position shown in FIG. 6. The inputting path of paper sheets, which is toward the rotational cutter 8 as the shredding part, is opened as shown in FIG. 4, so that paper sheets P are pushed toward a discharging direction by the feed roller 16 so as to be input into the rotational cutters 8.

Meanwhile, although not shown in the drawings, in the state of FIG. 7, when there are stapled paper sheets P2 (refer to FIG. 1), as when in FIG. 1, the front portion of a sheet of paper at the upper layer of the paper sheets is pulled, and resisting power against the pulling power is applied between the sheet of paper at the upper layer of the paper sheets and a sheet of paper at the lower layer thereof, so that the rear portion of the stapled paper sheets P2, i.e the stapled part thereof, are curved toward a front direction, which is the discharging direction of the paper sheets. At this time, the curved stapled part is caught by the catching tip 11*a* (refers to FIG. 3), which is an end of the catching board 11, and the feed roller 16 (refers to FIG. 2) continuously pushes a sheet of paper at the upper layer of the paper sheets so as to input it into the rotational cutters 8. Therefore, the sheet of paper input into the rotational cutters 8 can be released from the staple thereof and is shredded.

The present invention provides the automatic paper supply apparatus having the operational structure as shown in FIGS. 2 to 7. Therefore, it is possible to prevent a dangerous accident where the user's hand is sucked into the feed roller and is inserted between the rotational cutters duting a paper supplying process. Particularly, in a case of the feed roller having a metallic pin or a sharped protuberance formed at a surface thereof, a more serious accident can be prevented, thereby increasing safety in using the paper shredder more and more.

Furthermore, the present invention can prevent damage to devices of the paper shredder, which can be caused in a case where outer items is dropped down and input into the feed roller and the rotational cutters.

Embodiment 3

FIGS. 8 to 13 illustrate the third embodiment of the present invention. FIG. 8 is a schematic view illustrating the construction of an automatic paper supply apparatus, FIG. 9 is a perspective view of a paper shredder of FIG. 9, which includes the automatic paper supply apparatus of FIG. 8, and FIGS. 11 to 13 are schematic views sequentially illustrating the state of the paper shredder including an automatic paper supply apparatus of FIG. 8 while being used.

According to the present invention, the automatic paper supply apparatus has a structure where a catching board 32 and a roller cover 32*a*, which are shown in FIG. 2, are formed integrally with each other. More particularly, the paper shredder according to the present invention, which includes the automatic paper supply apparatus as shown in FIG, 8, includes a paper loading stand 21 which is slanted toward the interior of the paper shredder in a down direction so as to allow paper sheets to be shredded to be put thereon. A supporting jaw 24 is included at the front end of the paper loading stand 21 facing the interior of the paper shredder so as to keep and support the paper sheets P1 and the paper sheets P2 (refer to FIG. 11) to be shredded, which have been put on the paper loading stand 21.

Also, a lifting board 22, which can be rotated about one shaft upward in an upper direction, is included at the paper loading stand 21, and the lifting board 22 is elastically supported by a pressure spring 23 so as to perform a function for pushing the paper sheets P1 to be shredded toward a feed roller 26 positioned at the upper part of the paper shredder. Although not shown in the drawings, the pressure spring 23 can be connected with the upper part of the lifting board 22 so as to perform a function for pulling the lifting board 22 toward the feed roller 26.

In the present invention, the lifting board 22, which is adjacent to the feed roller 26 positioned at the upper part of the paper shredder as shown in FIG, 10, is preferably kept by the pressure spring 23 before the paper sheets to be shredded are put on the paper loading stand 21.

Also, a feed sensor 25 for sensing if paper sheets to be shredded are supplied is included at a side of the pressure spring 23. When paper sheets to be shredded are put on the lifting board 22 through the paper loading stand 21, the feed sensor 5 directly senses the descent of the lifting board 22 or the input of the sheaf of paper to be shredded and drives the feed roller 26 according to the result of the sensing.

The feed roller 26 has an upper part covered by a roller cover 32*a*. The roller cover 32*a* makes contact with an end of the body case 27 and is rotated by a rotational lever 34 connected with both sides of the main body case 27 so as to be opened.

A plurality of rotational cutters 29 for shredding supplied paper sheet sand a guide part 28 for guiding the paper sheets between the rotational cutters 29 are included at the lower part of the front portion of the paper loading stand 21. The rotational cutters 29 can be rotated by the driving motor 30 connected therewith through a belt 31 (a connection belt).

In the present invention, the paper shredder includes a catching board 32 as a means for releasing the stapled state of stapled paper sheets if there are the stapled paper sheets among paper sheets to be shredded, which have been put on the paper loading stand 21.

The catching board 32 is installed at an upper part of the paper shredder while being spaced from the paper loading stand 21 along a slanted surface thereof, and preferably has a shape formed integrally with an end of the roller cover 32*a*. Particularly, by lifting the catching board 32, the roller cover 32*a* is simultaneously rotated so as to be opened. The space between the catching board 32 and the paper loading stand 21 functions as an inputting opening 33 into which paper sheets to be shredded to be input. An end (a catching tip 32*b*) of the catching board 32, which is the entering part of the inputting opening 33, has a shape lifted upward so as to perform a function for catching the stapled part of the paper sheets during a shredding process.

The reference 'C', which is not described in FIG. 10, refers to an automatic paper supply apparatus, and the reference 'D' refers to an shredding part.

Also, the automatic paper supply apparatus C according to the present invention includes a control means which senses if the catching board 32 is lifted up or pulled down and controls the driving of a driving motor 30 (refers to FIG. 10). An electric or electron control apparatus, such as a micro switch or a sensor, etc., can be selected to be used as such a control means. In the present invention, the case of a micro switch 36 as an example of such a control means being used will be described through FIG. 8.

The micro switch 36 can be installed at the paper loading stand 21 (refer to FIG. 10) or at a position adjacent thereto, and an operation protuberance 35 as a means for controlling the micro switch 36 can be installed at a position corresponding to the position at which the micro switch 36 is installed. In the present invention, the micro switch 36 can be installed at one end of the lifting board 22 as described in FIG. 8, and the operation protuberance 35 can be installed at one end of the catching board 32, which is a position corresponding to the micro switch 36.

When the catching board 32, with which the roller cover 32*a* makes contact while rotating, is pulled down, the micro switch 36 is pushed by the operation protuberance 35 so as to make contact with it so as to keep the "ON" state. Meanwhile, when the catching board 32, which is opened as the roller cover 32*a* is rotated, is lifted up, the micro switch 18 is spaced and separated from the operation protuberance 35 so as to maintain the "OFF" state. The driving motor 30 is driven when of the micro switch 36 is turned on, and is stopped when the micro switch 36 is tuned off.

Of course, when the driving motor 30 is driven, the feed roller 26 is driven together with the rotational cutters 29. When the driving motor 30 is stopped, the feed roller 26 and the rotational cutters 29 are also stopped.

The numeric reference '22*a*', which is not described in FIGS. 8 to 10, refers to the rotational shaft, and the numeric reference '22*b*' is the latching protuberance.

The latching protuberance 22*b* is used for preventing the lifting board 22 lifted by the pressure spring 23 from making close contact with the feed roller 26. At least one side of the lifting board 22 has a protrusion-shape and is locked in the supporting jaw 24 while keeping a predetermined interval between the lifting board 22 and the feed roller 26.

Hereinafter, processes of shredding paper sheets in the papers shredder according to the present invention will be described with references to FIGS. 10 to 13.

FIG. 10 is a view illustrating the standby state of the automatic paper supply apparatus included in the paper shredder, which shows a state of the catching board 32, on which the roller cover 32*a* is closed, while being pulled down.

Also, in the case of the standby state of FIG. 10, when the operation protuberance 35 (refer to FIG. 8) turns on the micro switch 38 (refers to FIG. 8) so as to apply power to the paper shredder, the driving motor 30 can be driven so that the feed roller 26 and the rotational cutters 29 can be also driven.

With reference to FIGS. 11 and 12, in the paper shredder according to the present invention, paper sheets P1 to be shredded are input through the inputting opening 33 in a state where the roller cover 32*a* and the catching board 32 are pulled down. The input paper sheets P1 to be shredded are put on the paper loading stand 21 while having a front end thereof supported by the supporting jaw 24. In this state, the lifting board 22 is moved down due to the weight of the paper sheets and external force applied while they are input. Accordingly, as the feed sensor 25 senses the input of the paper sheets, the driving motor 30 is driven so that the paper roller 26 and the rotational cutters 29 are also driven.

Meanwhile, the paper sheets P1 loaded on the paper loading stand 21 have a highest layer making contact with the paper roller 26, and a sheet of paper at the highest layer of the paper sheets P1 to be shredded is sequentially discharged to the interior of the paper shredder by the rotation of the paper roller 26. Also, the sheets of discharged papers are input between the rotational cutters 29 along the guide part 28 so as to be shredded in pieces.

As shown in FIG. 12, if there are stapled paper sheets P2, a sheet of paper at the highest layer of the stapled paper sheets P2 is moved toward a discharging direction by the feed roller 26 so that a stapled part of the rear potion thereof is curved while being lifted in an front direction. In this state, the lifted stapled part is caught by the catching part 32*b* of the catching board 32, and the sheet of paper at the highest layer thereof, which has been carried by the feed roller 26, is pulled by the rotational cutters so as to be taken away from the paper sheets.

Accordingly, although stapled paper sheets have a large thickness thereof, the paper sheets can be sequentially shredded in such as manner that each sheet of paper is separated from the highest layer thereof so as to be shredded.

FIG. 13 is a view illustrating the state of the paper shredder in a case where a paper jam occurs in a process of shredding paper sheets, which shows the case where the catching board 32 having the opened roller cover 32*a* is lifted.

As such, in a case where a paper jam of the paper sheets P1 occurs in the interior of the shredder, the roller cover 32*a* and the catching board 32 are lifted toward an upper direction by the rotational lever 34. Therefore, the jammed paper can be removed without any resistance of interior elements.

Meanwhile, in a state where the catching board 32 is lifted as shown in FIG. 13, the operation protuberance 35 (refer to FIG. 8) is spaced and released from the micro switch 36 (refer to FIG. 8) so as to turn on the micro switch 36. Therefore, even though power is applied to the paper shredder, the driving motor 30 can not be driven so that the feed roller 26 and the rotational cutter 29 can not also be driven. Accordingly, the jammed paper can be removed in a safe manner.

The present invention may be applied to stapled paper sheets having a stapled part thereof far from the feed roller or also having a stapled part close thereto.

The present invention is suitable for paper sheets to be shredded having a small thickness thereof in a case where a stapled part thereof is positioned close to the feed roller. Meanwhile, in a case where a stapled part is far from the feed roller, the present invention can be applied to all paper sheets having a various thickness regardless of the pages of the paper sheets to be shredded.

In the present invention, it is preferable that the number of paper sheets, which are input all at once into the paper shredder by the feed roller, allow a shredding process to be performed without any burden. In a case where the number of supplied paper sheets exceed the proper burden of the apparatus, the paper shredder preferably has a construction which can automatically stop the shredding operation.

Although the present invention has been described through the embodiments and the accompanying drawings, the scope of the present invention is not limited therein, and those skilled in the art will appreciate that simple modifications are possible, without departing from the scope and spirit of the invention as disclosed in the accompanying claims.

INDUSTRIAL APPLICABILITY

As described above, when the paper shredder according to the present invention, which can shred stapled paper sheets, is employed, there is no need for the user to remove a staple from the stapled paper sheets so as to input the paper sheets into the paper shredder. Furthermore, if there are stapled paper sheets, the paper shredder can continuously perform a shredding operation without stopping, the quality of the automatic shredding operation of the paper shredder can increase without damage to the main body thereof, and the user can use it in an easier manner.

The invention claimed is:

1. An automatic paper supply apparatus for a paper shredder, comprising:

a paper supply part for supplying paper sheets to be shredded;

a shredding part for shredding paper sheets supplied by the paper supply part to pieces;

a paper loading stand for loading paper sheets to be shredded, the paper sheets being loaded while facing the shredding part;

a supporting jaw installed at a front end of the paper loading stand so as to keep and support the paper sheets to be shredded;

a lifting board included in the paper loading stand in such a manner that the lifting board can be rotated upward;

a feed sensor positioned at a lower part of the lifting board so as to sense if paper sheets to be shredded are supplied;

a feed roller positioned at an upper part of the lifting board, the feed roller being driven when the feed sensor senses paper sheets, and so as to carry the paper sheets to be shredded to the shredding part;

a pressing spring which elastically supports the lifting board and allows the paper sheets to be shredded, which have been put on the paper loading stand, to face the feed roller of an upper part of the paper shredder; and a catching board which is positioned above an upper part of the paper loading stand while being spaced from the paper loading stand, and allows a sheet of paper at an upper layer of stapled paper sheets to be released from the stapled part of the paper sheets.

2. The automatic paper supply apparatus for a paper shredder as claimed in claim 1, wherein the feed sensor may be a contact-type sensor or an optical sensor.

3. The automatic paper supply apparatus for a paper shredder as claimed in claim 1, wherein the shredding part includes a plurality of rotational cutters shredding paper sheets supplied by the feed roller and a driving motor connected with the rotational cutter by means of a predetermined connection means so as to transfer rotation power to the rotational cutters.

4. The automatic paper supply apparatus for a paper shredder as claimed in claim 3, wherein the driving motor is connected with the feed roller by means of a predetermined connection means.

5. The automatic paper supply apparatus for a paper shredder as claimed in claim 4, comprising a predetermined control means sensing if the catching board is lifted up or pulled down so as to control driving of the driving motor.

6. The automatic paper supply apparatus for a paper shredder as claimed in claim 5, wherein the control means may be a micro switch or a sensor.

7. The automatic paper supply apparatus for a paper shredder as claimed in one of claims 6, wherein the catching board is integrally connected with a roller cover covering an upper part of the feed roller.

8. The automatic paper supply apparatus for a paper shredder as claimed in claim 5, wherein the control means is installed at one side of the paper loading stand or the lifting board and includes an operation protuberance, as a means for operating the control means, installed at one end of the lifting board which corresponds to a position of the control means.

9. The automatic paper supply apparatus for a paper shredder as claimed in one of claims 8, wherein the catching board is integrally connected with a roller cover covering an upper part of the feed roller.

10. The automatic paper supply apparatus for a paper shredder as claimed in claim 8, wherein in a state where the catching board has been pulled down, the control means is pushed by the operation protuberance so as to make contact with the operation protuberance so as to maintain a "ON" state of the control means, in a state where the catching board has been lifted up, the operation protuberance is spaced and separated from the control means so as to maintain a "OFF" state, the driving motor can be driven in the "ON" state, and the driving motor can not be driven in the "OFF" state.

11. The automatic paper supply apparatus for a paper shredder as claimed in one of claims 10, wherein the catching board is integrally connected with a roller cover covering an upper part of the feed roller.

12. The automatic paper supply apparatus for a paper shredder as claimed in claim 5, wherein the catching board is integrally connected with a roller cover covering an upper part of the feed roller.

13. The automatic paper supply apparatus for a paper shredder as claimed in claim 4, wherein power transference by means of the connection means is performed by a belt, a chain, or a gear driving manner.

14. The automatic paper supply apparatus for a paper shredder as claimed in claim 3, wherein power transference by means of the connection means is performed by a belt, a chain, or a gear driving manner.

15. The automatic paper supply apparatus for a paper shredder as claimed in claim 3, wherein a guide part is included in each upper part of the rotational cutters so as to guide the paper sheets to be shredded between the rotational cutters.

16. The automatic paper supply apparatus for a paper shredder as claimed in claim 1, wherein the catching board is hinge-coupled at both ends of the lifting board in such a manner that the catching board can be rotated upward and downward, so that when a rear portion of the catching board is lifted, a front end of the catching board is rotated about a shaft and makes contact with an upper surface of a bottom of the lifting board at the front side of the catching board so as to block an inputting path of paper sheets.

17. The automatic paper supply apparatus for a paper shredder as claimed in claim 1, wherein a latching protuberance protrudes from at least one side of the lifting board so as to be locked in the supporting jaw while keeping a predetermined interval between the lifting board and the feed roller.

18. The automatic paper supply apparatus for a paper shredder as claimed in one of claims 17, wherein the catching board is integrally connected with a roller cover covering an upper part of the feed roller.

* * * * *